United States Patent [19]

Repinski et al.

[11] 4,212,463

[45] Jul. 15, 1980

[54] HUMANE BLEEDER ARROW

[76] Inventors: Robert J. Repinski, North Clarendon; Enoch B. Pratt, Wells, both of Vt.

[21] Appl. No.: 878,717

[22] Filed: Feb. 17, 1978

[51] Int. Cl.[2] ..... F41B 5/02

[52] U.S. Cl. ..... 273/418; 273/422

[58] Field of Search ..... 273/106.5 R, 106.5 A, 273/106.5 B; 29/413, 414, 415; 74/57; 124/24 R

[56] References Cited

U.S. PATENT DOCUMENTS

| | | | |
|---|---|---|---|
| 32,159 | 4/1861 | Waite | 29/415 |
| 615,019 | 11/1898 | Hershaw | 74/57 |
| 653,903 | 7/1900 | Bray | 29/413 X |
| 653,903 | 7/1900 | Bray | 29/413 X |
| 1,328,967 | 1/1920 | Reaben | 273/106.5 R |
| 1,769,034 | 7/1930 | Nell | 74/57 X |
| 2,125,591 | 8/1938 | Smith | 273/106.5 R X |
| 2,205,333 | 6/1940 | Baer | 74/57 X |
| 2,262,963 | 11/1941 | Procissi | 74/58 |
| 2,570,782 | 10/1951 | Evatt | 273/106.5 B |
| 2,909,372 | 10/1959 | Neri | 273/106.5 B |
| 3,393,912 | 7/1968 | De Lonais | 273/106.5 R |

FOREIGN PATENT DOCUMENTS

| | | | |
|---|---|---|---|
| 315347 | 2/1934 | Italy | 124/24 R |

*Primary Examiner*—Paul E. Shapiro

*Attorney, Agent, or Firm*—Snider, Steine & Saidman

[57] ABSTRACT

A humane hunting arrow which is particularly designed to most effectively obtain the utmost bleed-out possible for a given hit in the shortest period of time. The shaft of the arrow is hollow and is designed to facilitate passage of blood therethrough. Further, the shaft may be provided, either on its inside or outside surfaces, with one or a plurality of weakened areas in the form of grooves, scratches, scored or marked lines, or the like, for facilitating shearing of the arrow shaft thereat after the hit has been registered. Clean breakage of the arrow shaft at the point adjacent the animal's flesh facilitates bleed-out. The broadhead arrow tip includes an opening for creating a reservoir near the open front end of the arrow shaft for further facilitating and expediting the passage of blood therethrough. The element for attaching the broadhead to the shaft allows the complete inside diameter of the arrow shaft to be free of obstructions to further facilitate bleed-out. The attachment element further provides a tension arrangement which allows the pointed broadhead to easily enter the hide and to slide off bone and hard cartilage beneath the hide to enable the broadhead to penetrate the flesh of the animal deep enough to even further facilitate bleed-out.

19 Claims, 11 Drawing Figures

HUMANE BLEEDER ARROW

BACKGROUND OF THE INVENTION

1. Field of the Invention

The present invention is related to hunting arrows and, more particularly, is related to a bleeder arrow which includes a hollow shaft through which the blood of an animal hit by the arrow may pass.

2. Description of the Prior Art

It is well-known that an animal will usually bleed to death when hit hard with a broadhead arrow in almost any fleshy area. However, many big game animals hit with a broadhead are unfortunately not hit with an arrow that is placed well enough to cause death instantly or within a time frame that would minimize the animal's suffering. That is to say, many big game animals hit hard with a broadhead arrow must unfortunately suffer inhumanely for a considerable length of time until death occurs. Clearly, the suffering of the animal would be minimized if the bleeding which results from a hard hit broadhead arrow could be maximized. These factors also come into play when tracking an animal which has been hit by a broadhead. Normally, with a slow bleeding animal, it is difficult to track and find the kill and put the animal out of its misery. It is therefore clear that it would be highly desirable to expedite the bleed-out process in such a fashion that the suffering of the animal could be minimized.

Occasionally, an animal hit hard by a broadhead arrow can manage to pull and remove the broadhead and arrow shaft from its body. This action sometimes facilitates bleed-out, and sometimes retards it, depending upon the manner in which the broadhead is pulled out. That is, for example, since the blades of a broadhead are usually razor sharp, they sever the animal's tissue very cleanly, and when the arrow is removed from the body of the animal the tissue naturally falls back into place thereby sealing off the exit passage to a certain degree thereby inhibiting bleed-out. Further, muscle and fat tissue tend to close up and seal off slow bleeding areas to a certain degree in a natural attempt to heal the wound. In the case of an animal hit hard with a broadhead, the actual healing never takes place, and the foregoing process therefore unduly prolongs bleed-out and suffering of the animal.

The several materials from which present day arrow shafts may be made each contribute certain advantages and disadvantages relative to the animal's suffering described above. For example, with a solid wooden shaft, depending on the depth and location of the hit, it may be possible for the animal to remove the wooden shaft from the wound to provide for freer bleeding through the wound and faster death to the animal. However, when protruding from a fleeing animal, the shaft will generally break off close to the animal's side upon encountering resistance of heavy brush or trees. The portion of the solid arrow shaft remaining in the animal restricts bleeding thereby prolonging death and suffering of the animal. Additionally, as the animal bites and breaks the wooden shaft off when attempting to remove the broadhead from its body, the shaft breaks and splinters easily many times. Where the animal is not hit hard enough to cause death, he must continue to live with the broadhead and remaining portion of the shaft in his body.

In contrast, an aluminum shaft arrow is very tough and not as fragile as the wooden shaft arrow. Thus, when an animal is not hit hard enough with an aluminum shaft arrow to cause death, he may likely completely remove the broadhead and shaft from his body and continue to live in a humane manner. One hit hard with a broadhead may also remove an aluminum shaft to expedite bleeding and thereby minimize suffering. However, because an aluminum shaft does not easily break, it remains protruding from a fleeing animal, which increases the pain and suffering as the animal runs through trees and brush. In those rare instances where the aluminum shaft does happen to break it does not break off cleanly, but rather tends to kink or bend. The characteristics of fiberglass arrow shafts are quite similar to aluminum arrow shafts.

With any type of arrow shaft, when the broadhead becomes wedged behind the bone or cartilage of the animal, it is impossible for the animal to remove the arrow. In such a case, the animal must carry the shaft protruding from its body for the duration of the bleed-out process, which thereby becomes prolonged due to the restrictive nature of the shaft in the wound.

Those familiar with the sport of archery hunting know the advantages and disadvantages of both the sharp-pointed broadhead and the chisel-pointed broadhead. The chisel-pointed broadhead will usually slide off bone when the bone is not hit squarely and find its way deeper into the flesh, but many times it will glance off the animal's hide if the animal is running or standing in an off-and-away position to the shot. On the other hand, the sharp-pointed broadhead will usually enter the hide easily, but the sharp point may catch and become stopped by bone in many cases.

A conventionally attached (brazed or glued) chisel-pointed broadhead must move the complete shaft (about 30 inches from the tip to the trailing end) the distance of the angle taken by the broadhead when it changes direction sliding off the bone, which can reduce the efficiency of the shot.

It would be advantageous if a broadhead design could be provided that captures the advantages while eliminating any disadvantages of both common prior art broadhead designs.

The prior art teaches the provision of hollow arrow shafts to provide a flow-through passage for blood. Pertinent U.S. Pat. Nos. in this general area of which we are aware include: 1,604,713; 2,554,012; 3,393,912; 3,617,060; and 3,897,062.

The Cohen patent (2,554,012) is exemplary in illustrating a hollow arrow shaft 10 which includes perforations 13 therealong for receiving the blood. An arrowhead 16 is provided with blades 15 which are designed to prevent easy removal of the arrow. The De Lonais patent (3,393,912) illustrates a hollow cylindrical arrow shaft 6 provided at its forward end with a pair of blood inlet ports 28 and 30 and at its rear end with a pair of discharge ports 40.

While we have found that the prior art structures exemplified by these patents overcome some of the deficiencies of the solid wood, aluminum and fiberglass arrow shafts noted above, we find that they are still severely deficient with respect to providing the most expeditious and therefore humane bleed-out for an animal hit by a broadhead. One of the disadvantages of the prior art designs is their failure to take into account the various impedances to fluid flow created by changing internal diameters, obstructions, and the like, within the hollow arrow shafts. Clearly, such obstructions minimize fluid flow velocity thereby increasing bleed-out time.

None of the prior art references take into account the design of the broadhead in facilitating and expediting bleed-out. In fact, the broadheads of both Cohen an De Lonais, for example, are designed to maintain the arrow shaft within the animal, even in the case of a light hit. Since an animal hit with a broadhead will pull ferociously in an attempt to remove the arrow and broadhead from his body, the animal will often succeed, even with a barbed type arrowhead, thereby defeating the purpose of the hollow shafts. Further, barbed broadheads are generally inhumane, especially in cases of light hits where death would not normally result. Additionally, since it is likely that the hollow arrow shafts of the Cohen and De Lonais devices are made with aluminum or fiberglass (since the spine and flex requirements would be difficult to meet with a wooden arrow having a hollow shaft), and with their barbed broadheads are intended to prevent removal thereof from the body, the same inhumane treatment of a fleeing animal with a protruding arrow shaft hitting and banging on trees and brush would result as described above with respect to solid shafts.

Archery hunting from tree stands causes the arrow to enter the animal downwardly, so that the trailing end of the arrow is usually slightly upwardly from the animal's body. For the hollow arrow shaft of De Lonais, for example, the blood would have to travel against gravity for the full length of the shaft before exiting the outlet ports. It would naturally provide for a more expeditious bleed-out if such were not the case.

One of the main disadvantages of the prior art hollow arrow shaft designs, as exemplified by the Cohen and the De Lonais patents, is that, in spite of their hollow shafts, the bleed-out time is relatively slow compared to what it could be if the various factors and elements comprising such arrow shafts could be designed with maximum bleed-out in mind.

Of the remaining patents cited above, the Iezzi patent (3,617,060) discloses a hollow hunting arrow which is designed to induce lung collapse, while the Norlund patent (1,604,713) illustrates an arrow head 9 which is designed to prevent the arrowhead from being easily removed. Finally, the Christensen patent (3,897,062) teaches an arrowhead which is particularly designed to cause heavy bleeding.

OBJECTS AND SUMMARY OF THE INVENTION

It is therefore a general object of the present invention to provide an improved bleeder arrow which overcomes all of the deficiencies noted above with respect to prior art hunting arrows.

A primary object of the present invention is to provide a hollow arrow shaft by means of which the suffering period of the animal hit hard with a broadhead is greatly reduced by obtaining expeditious bleed-out of the animal, thereby providing for a quicker kill and hence minimizing the animal's suffering.

Another object of the present invention is to provide a highly effective and humane hunting arrow which is particularly designed to cause death to the animal that is hit hard with its broadhead in absolutely the minimum amount of time with respect to a given hit.

A still further object of the present invention is to provide a novel bleeder arrow design which permits the animal that is not hit hard enough to cause death to easily remove the complete broadhead and arrow shaft from its body and thereby allow it to continue to live a merciful and humane life.

Another general object of the present invention is to provide a novel and unique bleeder arrow design which incorporates all of the advantages of wooden, aluminum and fiberglass arrow shaft designs, while eliminating all of the disadvantages thereof.

A still further object of the present invention is to provide a novel bleeder arrow having a hollow shaft which is of simple design which may be easily and inexpensively manufactured by known technology, and which does not in any way threaten or depreciate the traditions or the sport of big game archery hunting.

Another object of the present invention is to provide a big game hunting arrow which is advantageous and humane for any given hit no matter what the depth of penetration and/or severity of the wound.

A more specific object of the present invention is to provide a unique hollow arrow shaft for use with a broadhead arrow tip which together minimize resistance to flow of the blood therethrough and thereby maximize bleed-out within the shortest possible period of time.

A still further object of the present invention is to provide a novel broadhead design for use in conjunction with a hollow arrow shaft which includes means for enhancing withdrawal of blood from the animal.

An additional object of the present invention is to provide a novel means for attaching the broadhead to the shaft which permits the former to shift from side to side under tension upon hard impact when the impact force is not squarely concentrated.

The foregoing and other objects are attained in accordance with one aspect of the present invention through the provision of a hunting arrow which comprises an elongated, hollow shaft having an inner surface, an outer surface and means formed thereon for facilitating the shearing of the shaft at the position thereof. The means in one embodiment comprises a plurality of individual grooves which extend circumferentially and are spaced longitudinally along the shaft. The plurality of grooves may be formed either on the inner surface or the outer surface of the shaft, and in its most simple form comprises a single groove which extends circumferentially about the shaft in a selected position.

In an alternate embodiment, the means comprises at least one groove spirally formed on the shaft on either its inner or outer surface. A second groove may be spirally formed on the shaft in a sense opposite to that of the first spiral groove, and there may further be included a plurality of spiral grooves intersecting and overlapping on the arrow shaft.

In accordance with other aspects of the present invention, the shaft includes an open front end and the inner surface thereof is smooth and of a substantially constant diameter along the entire length of the shaft to present minimum resistance to flow of blood therethrough. The invention may further include arrowhead means attached to the open front end of the shaft so as not to obstruct fluid flow thereinto. In a preferred form the arrowhead means may comprise a sleeve affixed to the outer surface of the shaft, a substantially planar broadhead removably mounted on the sleeve, and a substantially planar blade insert oriented at right angles to the broadhead and removably mounted on the sleeve and broadhead.

In accordance with yet other aspects of the present invention, the broadhead and the blade insert each include means formed therein for establishing a space between the animal tissue and the open end of the shaft to facilitate blood flow thereinto. The space establishing means in a preferred form includes aperture means formed in the broadhead and in the blade insert which are somewhat heart-shaped and form a reservoir-like space. The broadhead and blade insert each terminate at like ends thereof in spaced base prongs which are adapted to be received in the sleeve, and holes are preferably formed in the spaced base prongs for facilitating the installation and removal of the broadhead and the blade insert.

In accordance with another aspect of this invention, means are provided for coupling the broadhead to the shaft for permitting the former to shift laterally upon impact. In a preferred form, this means comprises spaced, planar base prongs in the broadhead having edgewise rectangular cutouts for spring-like positioning about a sleeve affixed to the front end of the shaft.

BRIEF DESCRIPTION OF THE DRAWINGS

Various objects, features and attendant advantages of the present invention will be more fully understood when considered in connection with the following detailed description of the present invention viewed in conjunction with the accompanying drawings, in which.

DETAILED DESCRIPTION OF THE PREFERRED EMBODIMENTS

Figures 1, 2, 3, 4, 5, 6:
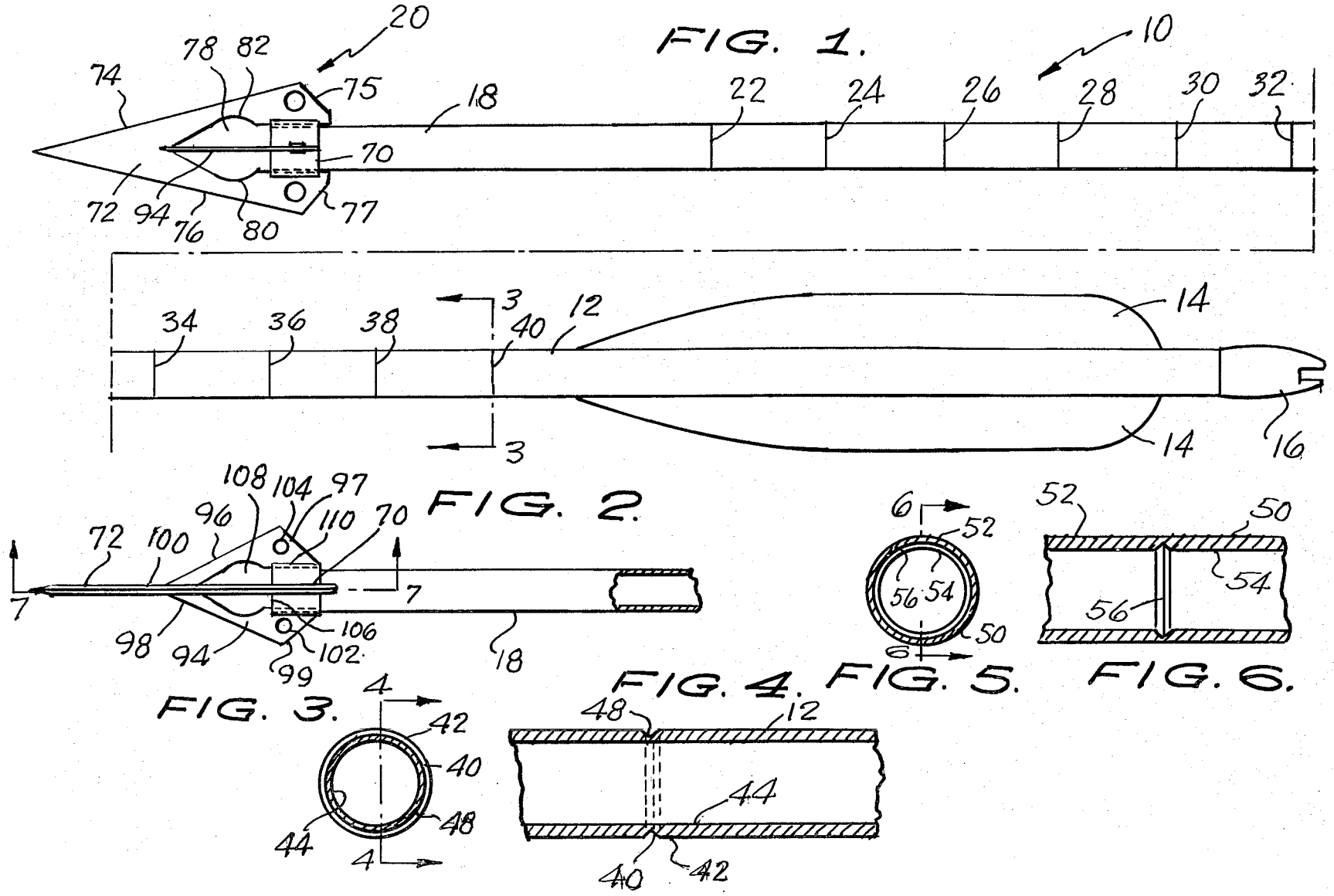
FIG. 1 is a side view of one preferred embodiment of the bleeder arrow of the present invention.
FIG. 2 is a side view, partially broken and partially in section, of the front end of the preferred embodiment of the arrow illustrated in FIG. 1.
FIG. 3 is a cross-sectional view of the arrow shaft of the preferred embodiment illustrated in FIG. 1 and taken along line 3—3 thereof.
FIG. 4 is a sectional view of the arrow shaft shown in FIG. 3 and taken along line 4—4 thereof.
FIG. 5 is a cross-sectional view of an arrow shaft of an alternate embodiment of the present invention.
FIG. 6 is a sectional view of the alternate embodiment illustrated in FIG. 5 and taken along line 6—6 thereof.

Referring now to the drawings, wherein like reference numerals represent identical or corresponding parts throughout the several views, and more particularly to FIG. 1 thereof, there is illustrated a preferred embodiment of the bleeder arrow of the present invention which includes a hollow arrow shaft that is indicated generally by reference numeral 10.

Hollow arrow shaft 10 includes a rear end 12 which is normally provided with fin means indicated by reference numeral 14 as well as a bifurcated tip 16 for receiving the bowstring, as is conventional.

The forward end 18 of the hollow arrow shaft 10 includes an arrowhead indicated generally by reference numeral 20, the structure and function of which will be described in greater detail hereinafter.

The preferred embodiment of the present invention illustrated in FIG. 1 is provided with a plurality of circumferentially formed weakened, marked or scored areas indicated by grooves 22, 24, 26, 28, 30, 32, 34, 36, 38 and 40. The weakened areas or grooves 22 through 40 are provided at spaced, regular positions along the length of arrow shaft 10 and are intended to facilitate the shearing of the arrow shaft 10 after the animal has been hit. That is, when the arrow shaft 10 protrudes from a fleeing animal that has been hit thereby, the grooved portions 22 through 40 cause the shaft to break off quickly and easily upon encountering the first resistance of trees, heavy brush, or the like. The arrow breaks off clean and completely allowing no portions to hang or dangle. While such characteristics are similar to those of a solid wooden arrow shaft, unlike the latter, the present invention will not restrict bleed-out when it remains in the wound after being broken off. In contrast, the present invention, due to the grooved hollow shaft that ensures a clean shear, and other design features to be described hereinafter, provides means whereby the blood exits the animal's body expeditiously in a minimum amount of time, therefore causing death to occur quickly and with a very minimal amount of suffering. More specifically, the clean break afforded by the scored or weakened area on the hollow arrow shaft provides a blood outlet port which is sized to the full undistorted circumference of the shaft which minimizes resistance to blood flow.

In the case of a hard hit, the shaft will break off close to the animal's side to provide the means for the portion of the shaft that is needed for blood drainage to remain in the animal without the need of a barbed type inhumane broadhead. The forwardmost groove 22 is preferably placed approximately two to six inches rearwardly of the arrowhead 20, thereby allowing an animal not hit hard enough to cause death to remove the broadhead by grasping the ungrooved portion of the shaft 10 between groove 22 and arrowhead 20. Such an animal will therefore be permitted to continue to live in a humane manner.

The arrow shaft 10 of the present invention is preferably comprised of a tough, durable material, such as for example, aluminum or fiberglass, in order to prevent splintering or uneven breakage of the shaft when the animal is pulling to remove it. Referring now to FIGS. 3 and 4, there are illustrated two sectional views of the arrow shaft 10 of FIG. 1. Reference numeral 42 refers to the outer surface of shaft 10, while reference numeral 44 refers to the inner surface thereof. Inner surface 44 of shaft 10 is preferably smooth and of a continuous diameter from one end of the shaft 10 to the other. Reference numeral 40 represents the groove formed in the outer circumference of shaft 10, in a manner to be described in greater detail hereinafter, and which is formed to a depth indicated by reference numeral 48. The grooves 22 through 40 may be of a depth inwardly of the outer surface 42 to the extent necessary to create the desired effect. Considerations include the type of material being utilized for the shaft 10, its strength, thickness and hardness, and other factors.

Figure 11:
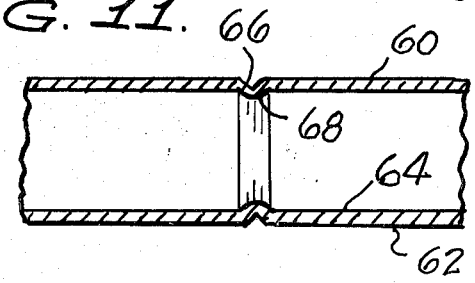
FIG. 11 is a sectional view similar to FIG. 4 but illustrating an alternate construction of the preferred embodiment of the present invention.

The process utilized to form the grooves 22 through 40 could be any well-known mechanical, chemical or electrical process. For example, the process may be such as to roll the material of an already-formed substantially cylindrical arrow shaft thereby displacing the material thereabout and forming the groove therein. The result of utilizing such a rolling process is illustrated in a sectional view in FIG. 11, wherein reference numeral 60 indicates the hollow arrow shaft. Hollow arrow shaft 60 includes an outer surface 62, an inner surface 64, and an outer groove 66 formed circumferentially thereabout by rolling. In this case, the material has a tendency to be pushed inwardly to form a corresponding inner groove 68 on the inner wall 64 of the hollow shaft 60. This, in turn, results in a negligible decrease in size in the inner diameter of the shaft 60, while the rolling process builds stress points into the length of the arrow shaft thereby allowing the shaft to flex without breaking as it normally would without the shear grooves. Accordingly, by rolling the grooves 66, the arrow shaft is provided with the means to flex as would a normal, unscored shaft, and is also provided with preformed weakened areas allowing the shaft to shear and break off and thereby function as an improved bleeder arrow according to the present invention.

As an alternative to forming the grooves by rolling, the grooves may be formed by cutting and removing material from particular areas along the shaft (e.g. by scoring, scratching, marking, or the like), by forming the material into the desired shape by building into the shaft the desired high and low stress areas, or by fluctuating the wall thickness of the material along the shaft as it is being constructed to thereby create the desired weakened areas. The shaft may also be formed by molding processes or any conventional technique.

The grooves or weakened portions of the arrow shaft may be formed on the outside surface of the shaft, as illustrated in FIGS. 1, 3 and 4, or on the inside surface thereof as illustrated, for example, in FIGS. 5 and 6 to which attention is now directed. Reference numeral 50 indicates a hollow arrow shaft having a smooth outer surface 52, an inner surface 54, and a scored groove or weakened area 56 extending circumferentially on the inner surface 54. It is preferred, for reasons which will become more clear hereinafter, to provide the weakened portions or grooves on the outer surface of the shaft, to thereby provide a smooth, continuous and constant diameter inner surface. Further, the grooves are more easily formed on the outer surface of the shaft, but it should be understood that it is clearly within the scope of the present invention to form the weakened portions on the inner surface.

The location of the grooves 22 through 40 (FIG. 1) along the shaft 10 may, as illustrated, range along the total length of the shaft. Alternatively, only a portion of the shaft may have the weakened areas, if desired. A factor which influences the positioning and number of grooves on the arrow shaft is the type of big game animal being hunted, since the arrow penetrates certain hides more easily and deeply than others.

Figure 8:
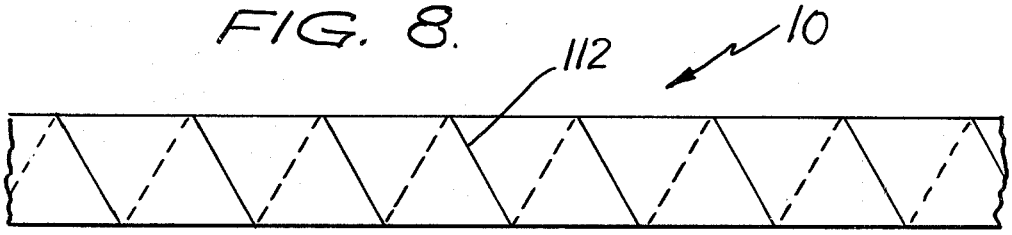
FIG. 8 is a partial view of an alternate embodiment of the present invention.
Figure 9:
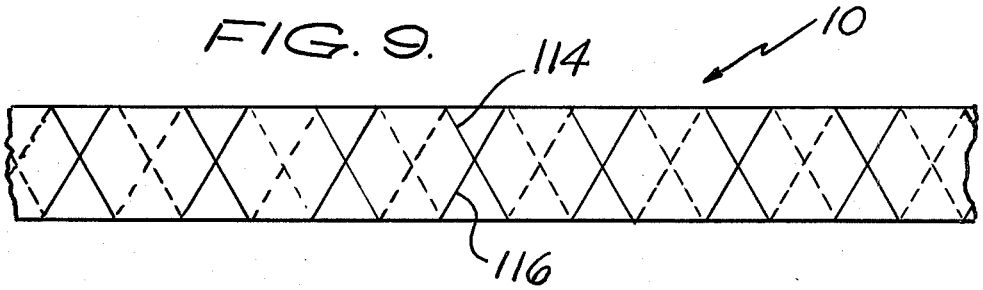
FIG. 9 is a partial view of yet another alternate embodiment of the present invention.
Figure 10:
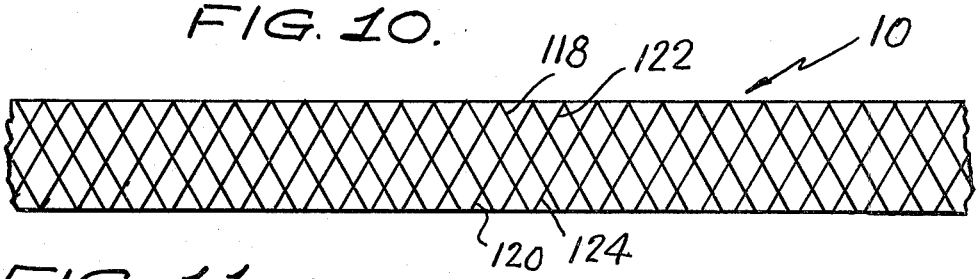
FIG. 10 is a partial view of yet another alternative embodiment of the present invention.

Referring now to FIG. 8, reference numeral 112 indicates a spiral groove formed along shaft 10, which, again, may be formed on the inside surface or outside surface thereof. FIG. 9 indicates by reference numerals 114 and 116 a pair of spiral grooves which are formed on opposite senses along the arrow shaft 10, along either the inner or outer surface thereof. FIG. 10 indicates multiple cross-spiral grooves 118, 120, 122 and 124 which again may be formed on either the inside or outside surface of shaft 10, or a combination thereof.

Clearly, other patterns of weakened portions or grooves are clearly within the spirit and scope of the present invention.

Figure 7:
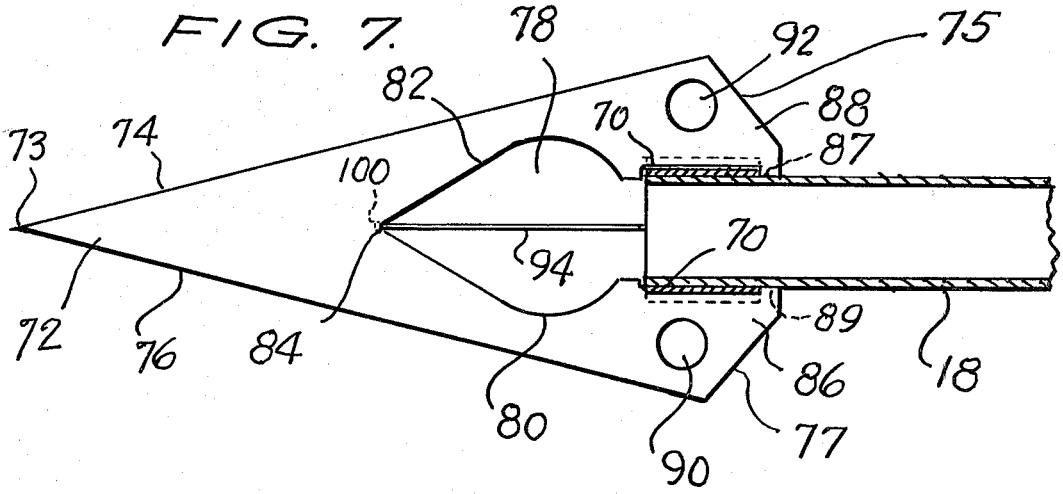
FIG. 7 is an enlarged, sectional view of the arrowhead illustrated in FIG. 2 and taken along line 7—7 thereof.

Referring back to FIGS. 1 and 2, and with reference also to FIG. 7, the arrowhead 20 of the present invention will now be explained in greater detail. The arrowhead 20 includes a substantially cylindrical sleeve member 70 open at both ends and affixed to the front end 18 of the shaft 10. A substantially planar broadhead 72 includes a pair of forwardly projecting sharpened edges 74 and 76 and a pair of rear edges 75 and 77. Centrally formed on broadhead 72 is a cut-out "reservoir" area 78, the size of which permits weight variations in the arrowhead 20 to be effectuated. The reservoir area 78 is, in a preferred embodiment, formed by a pair of heart-shaped edges 80 and 82 which meet at an apex 84. Rearward blade edges 75 and 77 form base portions 86 and 88 of broadhead 72 which are adapted to be mounted on the exterior of sleeve member 70. A pair of apertures 90 and 92 are provided in the bases 86 and 88, respectively, and are adapted to be engaged by a pair of reverse pliers to facilitate installation and removal of broadhead 72 on sleeve 70. Alternatively, a pair of angled cutouts, indicated in dotted outline by reference numerals 87 and 89, may be provided to permit the broadhead 72 to slidingly engage sleeve 70 without requiring pliers. The broadhead 72 is preferably heat treated to incorporate adequate spring tension.

A substantially planar razor blade insert 94 is positioned at right angles with respect to the plane of broadhead 72 and includes a pair of forwardly projecting sharpened edges 96 and 98 as well as a pair of rearwardly projecting sharpened edges 97 and 99. The front edges 96 and 98 meet in a bifurcated tip 100 which fits about the apex 84 of reservoir area 78 of broadhead 72. The rearward portion of razor blade insert 94 is provided with spaced bases 106 and 110 which also include a pair of apertures 102 and 104 to facilitate installation and removal thereof. Similar to broadhead 72, razor blade insert 94 is provided with a heart-shaped cut out 108 which, together with cut out 78, forms a unique reservoir area.

The reservoir area defined by the cut outs 78 and 108 receive the flowing blood from the tissue severed by edges 74, 76, 96 and 98 and guide it towards and into the open end of the hollow shaft. This facilitates the entrance of the blood from the severed animal tissue into the end of the hollow arrow shaft to thereby further expedite the bleed-out of the animal. In use, the edges of the broadhead 72 and insert 94 form a reservoir area with cut outs 78 and 108 into which the blood from the animal tissue collects, to thereafter enter the hollow shaft 10, flow rapidly along its inside surface and exit outside the animal's body where the shaft 10 has been sheared at a weakened area thereof.

The broadhead 72 has a relatively sharp forward tip 73 which ensures easy penetration into the animal's hide under most conditions. Due to the mode of attachment of the base portions 86 and 88 to sleeve 70, the broadhead 72 is able to shift from side to side under tension upon hard impact when the impact force is not squarely concentrated. Such would be the case when hitting a bone or hard cartilage off center. There is no danger of the broadhead becoming unattached to the arrow shaft. After passing the bone the broadhead 72 will automatically right itself in place on the sleeve 70 of shaft 18.

An important feature of the present invention is the provision of minimal resistance to flow of the blood from the point where the arrowhead enters the tissue through to the exit area from the hollow shaft. Preferably, the inner surface of the hollow shaft is smooth and of a substantially constant diameter along its entire length. Therefore, the shaft 10, in combination with the unique arrowhead design 20, permits liquid to enter freely and unrestricted the full inside diameter of the shaft and exit from the full inside diameter thereof. As distinguished from the prior art, the present invention in a preferred form provides no inserts in the shaft, no change in diameter size where the liquid must flow, no restriction in the full inside diameter of the shaft with respect to the entry or exit of liquid, and no change in the shape of the passage within which the blood flows. The arrowhead 20 is fastened to the shaft on the outside thereof to prevent disturbance to the free and rapid flow of blood into, through and out from the shaft.

It may be appreciated by virtue of the foregoing that we have provided a new and unique big game hunting arrow which, by means of weakened areas along the inside and/or outside surface of the shaft, in conjunction with a novel arrowhead design, ensures that an animal which is hit hard with the broadhead will be killed in a minimum amount of time, provides means whereby an animal that is not hit hard enough with the broadhead to cause death may easily remove the complete broadhead and shaft from its body and continue to live a merciful and humane life, provides all of the advantages of wooden, aluminum and fiberglass arrow shafts while avoiding the disdvantages thereof, and thereby provides a most effective, humane hunting arrow.

The positioning of the weakened areas along the shaft may be controlled to ensure a uniform, accurate, and safe shear strength for the shaft of the arrow. This may, naturally, differ from arrow to arrow to suit a particular bow draw and weight. The manufacturing process may also be controlled such that the spine and flex of the arrow will be comparable to a conventional arrow of the same class and category for a particular bow size and type, including the new compound bow.

The present invention also permits the broadhead to shift independently of the shaft under tension. It is neither brazed nor glued to the shaft, as with prior art designs, and therefore shooting efficiency is further enhanced.

Inasmuch as the present invention is designed to provide for the most expeditious bleed-out of the animal, it follows that more blood will be shed in a shorter distance, thereby providing an easier-to-follow blood trail when tracking the animal. This, in turn, will result in more finds and less kills in vain. It will also result in faster finds, which means that a wounded animal can be found sooner and put out of its misery.

Obviously, numerous modifications and variations of the present invention are possible in light of the above teachings. It is therefore to be understood that within the scope of the appended claims, the invention may be practiced otherwise than as specifically described herein.

We claim as our invention:

1. Apparatus, which comprises a hunting arrow including an elongated, hollow shaft having an inner surface, an outer surface and groove means formed thereon for facilitating the shearing of said shaft at the position thereof, said groove means comprising at least one groove extending circumferentially about said shaft, wherein said inner surface is smooth and of a substantially constant diameter along the entire lenght of said shaft and wherein said arrow includes an open front end at the forward portion of said shaft of a diameter equal to said constant diameter, and further comprising arrowhead means attached to said open front end of said arrow so as not to obstruct fluid flow thereinto, said arrowhead means comprising a sleeve affixed to said outer surfaces of said shaft, a substantially planar broadhead removably mountable on said sleeve, and a substantially planar blade insert oriented at right angles to said broadhead and removably mountable on said sleeve and broadhead.

2. The apparatus as set forth in claim 1, wherein said broadhead and said blade insert each include means formed therein for establishing a space between the animal tissue and said open end of said shaft to facilitate blood flow thereinto.

3. The hunting arrow as set forth in claim 2, wherein said space establishing means includes apertures formed in said broadhead and in said blade insert.

4. The hunting arrow as set forth in claim 3, wherein said apertures are somewhat heart-shaped.

5. The hunting arrow as set forth in claim 3, wherein said broadhead and said blade insert each terminate at like ends thereof in spaced base prongs adapted to be received in said sleeve.

6. Apparatus, which comprises a hunting arrow, including a hunting broadhead, a nock and a shaft, said shaft comprising an elongated, hollow shaft having an inner surface, an outer surface and means formed thereon for facilitating the shearing of said shaft at the position thereof, wherein said means comprises a plurality of individual grooves extending circumferentially and spaced longitudinally along said shaft.

7. The apparatus as set forth in claim 6, wherein said plurality of grooves are formed on the inner surface of said shaft.

8. The apparatus as set forth in claim 6, wherein said plurality of grooves are formed on the outer surface of said shaft.

9. Apparatus, which comprises a hunting arrow including a hunting broadhead, a nock and a shaft, said shaft comprising an elongated, hollow shaft having an inner surface, an outer surface and means formed thereon for facilitating the shearing of said shaft at the position thereof, wherein said means comprises at least one groove spirally formed on said shaft, said groove extending in a spiral fashion about the circumference of said shaft a plurality of times and having a pitch approximately on the order of magnitude or less than the diameter of said shaft.

10. The apparatus as set forth in claim 9, wherein said groove is formed on the inner surface of said shaft.

11. The apparatus as set forth in claim 9, wherein said groove is formed on the outer surface of said shaft.

12. The apparatus as set forth in claim 9, further comprising a second groove spirally formed on said shaft in a sense opposite to that of said one groove.

13. The apparatus as set forth in claim 9, further comprising a plurality of grooves spirally formed on said shaft.

14. A hunting arrow, which comprises a hunting broadhead, a nock and a shaft, said shaft comprising an elongated, hollow shaft having an inner surface, an outer surface and groove means formed thereon for facilitating the shearing of said shaft at the position thereof, wherein said groove means comprises at least one groove extending circumferentially about said shaft.

15. A hunting arrow, which comprises an elongated, hollow shaft having an inner surface, an outer surface and means formed thereon for facilitating the shearing of said shaft at the position thereof, said shaft including an open front end and further comprising arrowhead means attached to said open front end of said shaft so as not to obstruct fluid flow thereinto;

wherein said arrowhead means comprises a sleeve affixed to said outer surface of said shaft, a substantially planar broadhead removably mountable on said sleeve, and a substantially planar blade insert oriented at right angles to said broadhead and removably mountable on said sleeve and broadhead, said broadhead and said blade insert each including means formed therein for establishing a space between the animal tissue and said open end of said shaft to facilitate blood flow thereinto, said space establishing means including apertures formed in said broadhead and in said blade insert;

wherein said broadhead and said blade insert each terminate at like ends thereof in spaced base prongs adapted to be received in said sleeve, and further comprising hole means formed in said spaced base prongs for facilitating installation and removal of said broadhead and said blade insert.

16. A hunting arrow, which comprises an elongated, hollow shaft having an inner surface, an outer surface and means formed thereon for facilitating the shearing of said shaft at the position thereof, said shaft including an open front end and further comprising arrowhead means attached to said shaft so as not to obstruct fluid flow thereinto, and further comprising means for coupling said arrowhead means to said shaft to permit said arrowhead means to shift laterally with respect to said shaft upon impact, said coupling means comprising a sleeve affixed to the outer surface of one end of said shaft, said arrowhead means including spaced base prongs adapted to be received about said sleeve;

wherein said arrowhead means comprises a substantially planar broadhead with said prongs formed at the rearward end thereof and including means for accommodating said sleeve therewithin.

17. The hunting arrow as set forth in claim 16, wherein said sleeve accommodating means comprises a pair of elongated cutouts one formed on the inner edge of each of said prongs.

18. Apparatus, which comprises a hunting arrow including an elongated, hollow shaft having an inner surface, an outer surface and groove means formed thereon for facilitating the shearing of said shaft at the position thereof, said groove means comprising a plurality of individual grooves extending circumferentially and spaced longitudinally along said shaft, wherein said inner surface is smooth and of a substantially constant diameter along the entire length of said shaft and wherein said arrow includes an open front end at the forward portion of said shaft of a diameter equal to said constant diameter, and further comprising arrowhead means attached to said open front end of said arrow so as not to obstruct fluid flow thereinto, said arrowhead means comprising a sleeve affixed to said outer surfaces of said shaft, a substantially planar broadhead removably mountable on said sleeve, and a substantially planar blade insert oriented at right angles to said broadhead and removably mountable on said sleeve and broadhead.

19. Apparatus, which comprises a hunting arrow including an elongated, hollow shaft having an inner surface, an outer surface and groove means formed thereon for facilitating the shearing of said shaft at the position thereof, said groove means comprising at least one groove spirally formed on said shaft, said groove extending about the circumference of said shaft a plurality of times and having a pitch approximately on the order of magnitude or less than the diameter of said shaft, wherein said inner surface is smooth and of a substantially constant diameter along the entire length of said shaft and wherein said arrow includes an open front end at the forward portion of said shaft of a diameter equal to said constant diameter, and further comprising arrowhead means attached to said open front end of said arrow so as not to obstruct fluid flow thereinto, said arrowhead means comprising a sleeve affixed to said outer surface of said shaft, a substantially planar broadhead removably mountable on said sleeve, and a substantially planar blade insert oriented at right angles on said sleeve and broadhead.

* * * * *